US005741125A

United States Patent [19]

Neftel et al.

[11] Patent Number: 5,741,125

[45] Date of Patent: Apr. 21, 1998

[54] PERISTALTIC PUMP DEVICE HAVING AN INSERT CASSETTE OF REDUCED COMPLEXITY

[75] Inventors: Frédéric Neftel, Lausanne, Switzerland; Bernard Bouvier, Eragny, France

[73] Assignee: Debiotech S.A., Lausanne, Switzerland

[21] Appl. No.: 737,375

[22] PCT Filed: May 11, 1995

[86] PCT No.: PCT/FR95/00617

§ 371 Date: Oct. 29, 1996

§ 102(e) Date: Oct. 29, 1996

[87] PCT Pub. No.: WO95/31643

PCT Pub. Date: Nov. 23, 1995

[30] Foreign Application Priority Data

May 11, 1994 [FR] France ..... 94 005794

[51] Int. Cl.[6] ..... F04B 43/09

[52] U.S. Cl. ..... 417/477.7; 417/477.2; 604/153

[58] Field of Search ..... 417/477.1, 477.2, 417/477.7, 477.8, 360; 604/153

[56] References Cited

U.S. PATENT DOCUMENTS 3,447,478 6/1969 Clemens ..... 417/477.8
4,178,138 12/1979 Iles ..... 417/360
4,548,553 10/1985 Ferster ..... 417/477
4,705,464 11/1987 Arimond ..... 417/477
5,044,902 9/1991 Malbec ..... 417/477
5,518,378 5/1996 Neftel et al. ..... 417/477.2

FOREIGN PATENT DOCUMENTS 2 644 212 9/1990 France .

OTHER PUBLICATIONS

Preliminary International Search Report Issued for PCT/FR95/00617.

*Primary Examiner*—Timothy Thorpe
*Assistant Examiner*—Peter G. Korytnyk
*Attorney, Agent, or Firm*—Wolf, Greenfield & Sacks, P.C.

[57] ABSTRACT

The invention relates to a peristaltic pump system. The pump system comprises both an insert (10) and a motor assembly (30). The insert essentially comprises a wall (16) and a duct (22) of deformable material. The motor assembly comprises a drive shaft (38), a plate (50) on which rotary means (54, 64) are mounted to guide wheels (48) suitable for co-operating with the duct (22). When the shaft (38) is inserted, the wheels (48) are spread outwards and compress the duct (22) between themselves and the wall (16) of the insert.

13 Claims, 6 Drawing Sheets

PERISTALTIC PUMP DEVICE HAVING AN INSERT CASSETTE OF REDUCED COMPLEXITY

BACKGROUND OF THE INVENTION

1. Field of the Invention

The present invention relates to a peristaltic pump system.

2. Description of Related Art

Peristaltic pumps are used, particularly but not exclusively, in the medical field to deliver medication in liquid form, e.g. for perfusions at a very regular flow rate.

In conventional manner, e.g. as described in French patent applications Nos. 2 383 333 or 2 644 212, these pumps comprise a motor assembly and a cassette. The cassette is essentially constituted by a tube in which the liquid to be pumped flows, said tube being deformable and pressed against a wall. Within a loop formed by the tube, there are to be found a plurality of wheels that are driven so that they revolve together, the wheels squeezing the tube locally. The wheels are driven by rotating the shaft of the motor assembly when the cassette is mounted thereon. Between points where it is squeezed, the tube defines liquid-filled chambers, and rotation of the wheels causes the chambers to move away from the tube inlet and towards the tube outlet. This causes liquid to be transferred from the tube inlet to its outlet at a flow rate that is very accurate and depends firstly on the volume of the tube between two squeeze points, and also, of course, on the speed with which the wheel assembly revolves.

It will be understood that between two medication-dispensing operations, the motor portion of the pump can be retained while the tube must naturally be changed, and in fact it is the entire cassette that needs to be changed. Unfortunately, the cassette contains not only the tube but also the drive wheels, and they need to be machined very accurately in order to achieve high pumping accuracy in practice. In other words, although the cost of the cassette is small compared with that of the motor assembly, it is nevertheless not negligible.

SUMMARY OF THE INVENTION

An object of the present invention is to provide a peristaltic pump system in which the "cassette" that needs to be discarded after each use is simpler in structure and is therefore cheaper.

To achieve this object, the peristaltic pump system of the invention is characterized in that it comprises:

a first assembly comprising:

rotary drive means;

a shaft rotated by said drive means and having a free end;

a housing presenting a cavity into which said free end of said shaft projects;

a plurality of wheels, each wheel having a pivot axis and an active tread face that is symmetrical about said axis; and mounting means for said wheels and comprising:

a plate mounted to move in said cavity along the axis of said shaft and having an orifice suitable for allowing the free end of said shaft to pass therethrough; and movable means movable in rotation about the axis of said shaft relative to said plate, said movable means comprising means for substantially preventing said wheels from moving in translation relative to said plate along their pivot axes, for holding the pivot axes of said wheels parallel to said axis of the shaft, for allowing each wheel to rotate, and for guiding the axes of said wheels in translation along radial directions; and a second assembly, independent of the first and comprising:

a wall including at least a cylindrical portion; and a deformable tubular duct secured to the inside face of said wall;

whereby, by engaging said second assembly around the wheels of the first assembly, the tread walls of said wheels come into contact with said tubular duct towards the axis of rotation of the mounting means in such a manner that a portion of each wheel is disposed facing said orifice; and whereby, by pushing down said mounting means into the cavity of said first assembly, the free end of said shaft penetrates through said orifice so that the side wall of the shaft comes into contact with the tread walls of said wheels to spread said wheels apart in radial directions away from the axis of the shaft, thereby causing said tubular duct to be locally squeezed between said wheels and said wall of said second assembly.

It will be understood that the so-called "second" assembly constitutes the equivalent of a portion of a prior art cassette, and is referred to herein as an "insert". Its structure is very simple since it comprises no more than a wall portion, preferably provided with a cover, and associated with the portion of deformable hose that co-operates with the wheels. This structure is thus very simple and cheap. It will be understood that the set of wheels forms an integral portion of the first assembly, i.e. the motor unit, and this is naturally not changed between two uses of the peristaltic pump.

It will also be understood that because of the presence of the plate and the mounting means, it is possible to select wheels of different diameters from one pump to another, thereby making it possible to modify the pump flow rate for a given speed of rotation. Naturally, the diameter of the shaft of the drive motor must be adapted to the diameter of the wheels in order to ensure contact between the shaft and the wheels.

In a preferred embodiment of the pump system, said cavity of the housing of the first assembly is substantially circularly cylindrical about said shaft and includes a bottom, and it is characterized in that said cavity further includes means for guiding said plate in translation along the axis of said shaft, and in that said cavity is provided with resilient means interposed between said bottom and said plate tending to move said plate away from said bottom.

Also preferably, said wheel mounting means comprise a turntable mounted to rotate freely on said plate about the axis of the orifice in said plate and provided with a passage in register with said orifice and suitable for passing said shaft.

BRIEF DESCRIPTION OF THE DRAWINGS

Other characteristics and advantages of the present invention appear more clearly on reading the following description of an embodiment of the invention given by way of non-limiting example. The description refers to the accompanying drawings, in which.

DETAILED DESCRIPTION OF THE INVENTION

As already mentioned, the peristaltic pump system of the invention comprises firstly a motor assembly and secondly another assembly constituting an insert.

Figure 1:
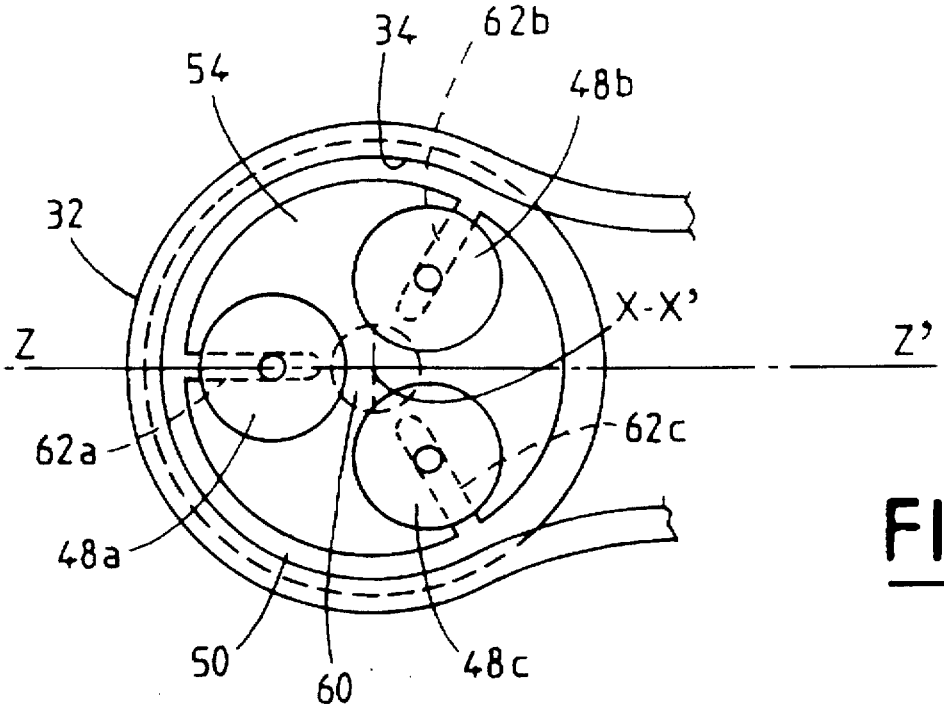
FIG. 1 is a plan view of the motor unit before the insert is put into place.
Figure 2:
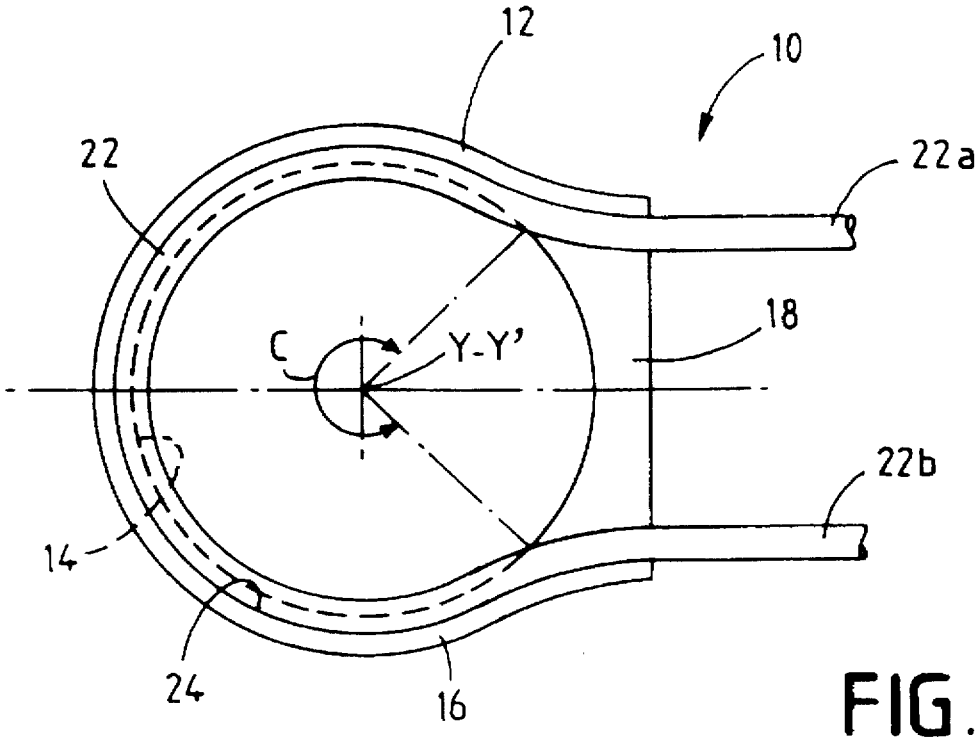
FIG. 2 is a plan view of the insert.
Figure 3:
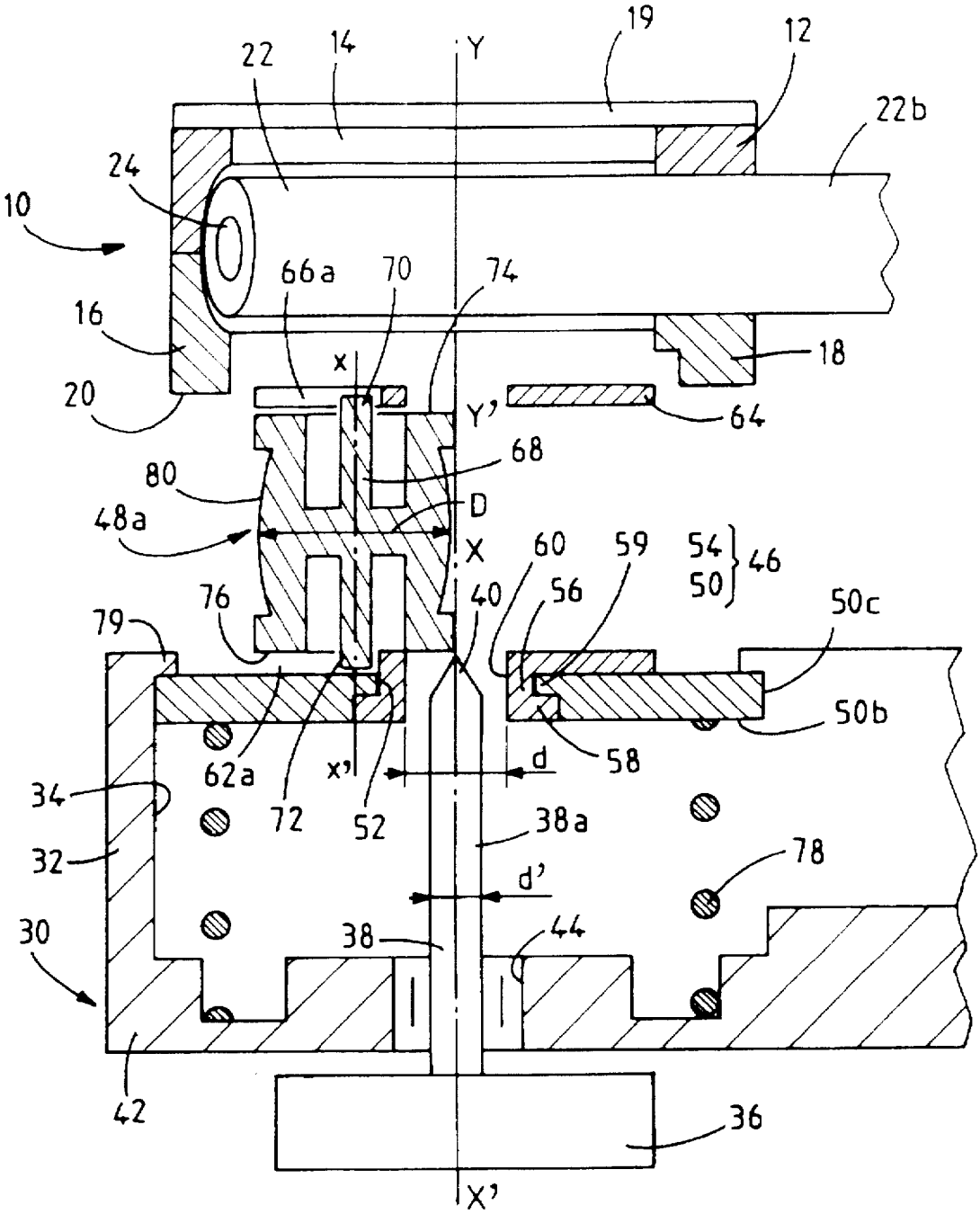
FIG. 3 is a vertical section view through the pump system showing the insert and the motor unit separate.

With reference initially to FIGS. 2 and 3, the insert given overall reference 10 is described initially. As shown in FIG. 2, the insert 10 comprises a housing 12 defining a cylindrical inside cavity 14. The cavity 14 is defined by a cylindrical side wall 16 of the housing occupying an angle at the center C that is greater than 180° and that is about 210°, for example, the wall of the cavity being finished off by a solid portion 18. As shown better in FIG. 3, the top edge of the wall 16 is preferably closed by an optionally transparent cover 19. In contrast, the bottom edge 20 of the wall 16 is open. In other words the cavity 14 opens out to the bottom. Inside the cavity 14 there is a tubular duct 22 made of a deformable material as explained below. Preferably, at rest, the right section of the tubular duct 22 is substantially elliptically shaped with its major axis parallel to the height direction of the wall. The tubular duct 22 is received more precisely in a curved recess 24 in the inside face of the wall 16. The inlet end 22*a* and the outlet end 22*b* of the tube 22 are fixed in the solid portion 18 of the housing of the insert 10. The tube 22 is thus held completely immobile inside the housing of the insert. As shown in FIG. 1, the face of the tube 22 directed towards the inside of the cavity 14 is free.

With reference now to FIGS. 1 and 3, a first embodiment of the motor portion of the peristaltic pump system is described. The motor portion is given overall reference 30 and essentially comprises a housing 32 defining a cavity 34 suitable for receiving the cassette 10 as explained below. The motor portion 30 also includes, mounted on the housing 32, a motor 36 of appropriate type whose outlet shaft 38 projects into the cavity 34 along the axis of symmetry XX' of the cavity. In this embodiment, the shaft 38 has a frustoconical free end 40. As shown better in FIG. 1, the shape of the internal cavity 34 of the housing 32 coincides with the outside shape of the housing 12 of the cassette. The cavity 34 has a bottom 42 through which the shaft 38 passes via an opening 44. Inside the cavity 34, there is an assembly 46 for mounting wheels 48. In the particular embodiment described with reference to FIGS. 1 and 3, the number of wheels is equal to three and they are referenced 48*a*, 48*b*, and 48*c*.

The mounting assembly 46 is essentially constituted by a plate 50 whose outside edge 50*c* coincides with the inside wall of the cavity 34. The plate 50 can thus move inside the cavity 34 while being guided in translation along the axis XX'. The plate 50 has an axial orifice 52.

A wheel-guiding turntable 54 is mounted on the plate 50. In the example shown, the turntable 54 is mounted to rotate about the axis XX' relative to the plate 50, but it is prevented from moving in translation relative to said plate along the axis XX'. This result is obtained, for example, by providing a cylindrical sleeve 56 in the central portion of the turntable 54, which sleeve is terminated by a lip 58 that co-operates with a bottom shoulder 59 in the center of the plate 50. The sleeve 56 and the turntable 54 together define an axial orifice 60 of diameter d greater than the diameter d' of the shaft 38. The turntable 54 has radial slots 62*a*, 62*b*, and 62*c* equal in number to the number of wheels 48. The turntable 54 is finished off by a top disk 64 secured to the turntable 54 and itself provided with radial slots 66*a*, 66*b*, and 66*c* coinciding with the underlying slots 62*a*, 62*b*, and 62*b* of the turntable 54.

Each wheel 48*a* to 48*c* has its own axis of rotation xx' embodied by a shaft 68 whose ends 70 and 72 project beyond the end faces 74 and 76 of each wheel. The ends 70 and 72 of each wheel shaft penetrate into the slots 62 and 66 respectively in the turntable 54 below and the disk 64 above. The distance between these two members is very slightly greater than the height h of the wheels, thereby allowing the wheels to rotate freely about their axes xx' while being substantially prevented from moving in translation parallel to the axis XX'. As shown in FIG. 3, each wheel has a preferably-bulging tread face 80 of diameter D about its axis xx'.

Also, a spring 78 or any other appropriate resilient system is located inside the cavity 34 of the motor unit and is interposed between the bottom 42 of the cavity and the bottom face 50*b* of the plate 50. The spring therefore tends to keep the plate 50 in its high position inside the cavity 54, the plate being retained by a shoulder 79 at the periphery of the cavity 34.

Figure 4:
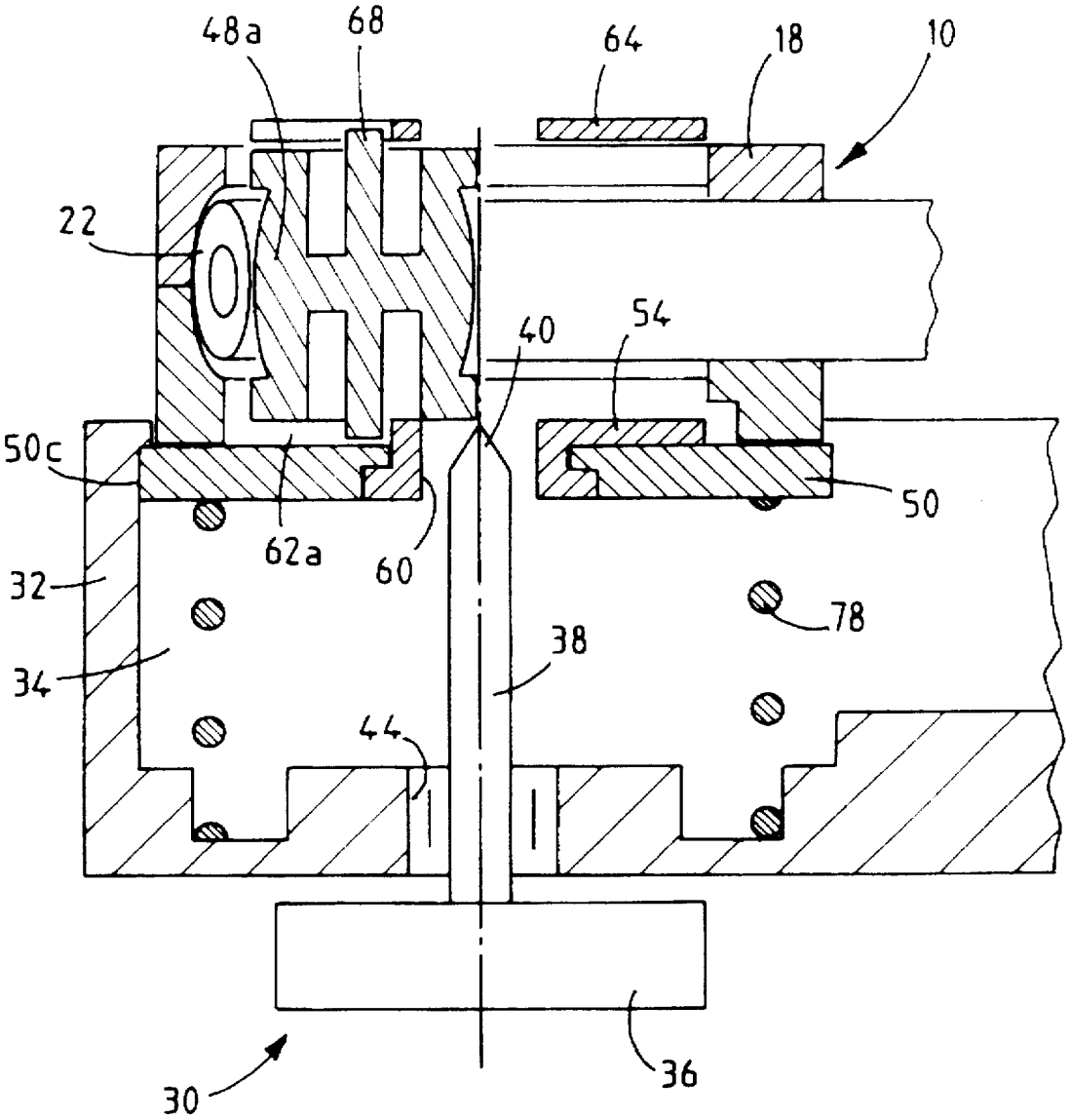
FIG. 4 is a view similar to FIG. 3 but showing the insert engaged on the wheels of the motor unit.

With reference now more particularly to FIGS. 3 and 4, there follows a description of how the peristaltic pump system constituting a first embodiment of the invention is used.

Initially, the motor assembly 30 has its plate 50 in the high position with the wheels 48*a* to 48*c* held captive thereon. The insert 10 is separate and has fixed therein a portion of tubes 22 along which the liquid to be pumped will flow. This is shown in FIG. 3.

The insert 10 is firstly engaged around the wheels 48 of the motor unit 30. This engagement is easily performed since the wheels 48 are free to move towards the axis XX' on contact being made between the portion of the tube 22 that projects into the cavity of the insert and the tread surfaces 80 of the wheels 48*a* to 48*c*. As shown in FIG. 4, at the end of this operation, a portion of the bottom end face 76 of each wheel 48 overlies the axial orifice 60 in the turntable 54.

FIG. 4 shows the insert engaged around the wheels 48. The wheels and the insert are held in the high position by the spring 78 urging the plate 50 towards the top end of the cavity 34 where it is held by the shoulder 79. The insert 10 and thus the plate 50 is then pushed down, thereby compressing the spring 78. During this operation, the frustoconical end 40 of the shaft 38 progressively pushes against the wheels 48*a* to 48*c*, moving them away from the axis XX', with this naturally tending to compress the tube 22 locally in three contact zones. As they move outwards, the wheels are guided by the radial slideways 62 and 66. Once the plate 50 has been pushed fully down together with the insert 10 into the cavity 34, the side wall 38*a* of the drive shaft 38 co-operates with the three wheels 48*a*, 48*b*, and 48*c* by pressing against the tread walls 80 thereof, with the wheels closing off the tube 22 completely at their points of contact therewith. Once this operation has been completed, clip means (not shown in the figures) serve to hold the insert 10 inside the cavity 34 of the housing 32. In this position, the peristaltic pump system is ready to operate.

As is well known, under drive from the motor 36, rotation of the shaft 38 in frictional contact with the tread walls of the wheels 48 causes the wheels to rotate about their own axes xx' and causes the set of wheels to revolve about the axis XX' on the turntable 54. This causes liquid to flow along the duct 22.

In addition, it should be emphasized that because of the presence of the plate 50 and of the turntable 54 for guiding the wheels 48, it is possible to select the number and diameter D of the wheels so as to define the flow rate for a given speed of rotation of the shaft 38. Naturally it is necessary to adapt the diameter d' of the shaft to ensure that the tube 22 is properly closed off at its points of contact with the wheels.

Figure 5:
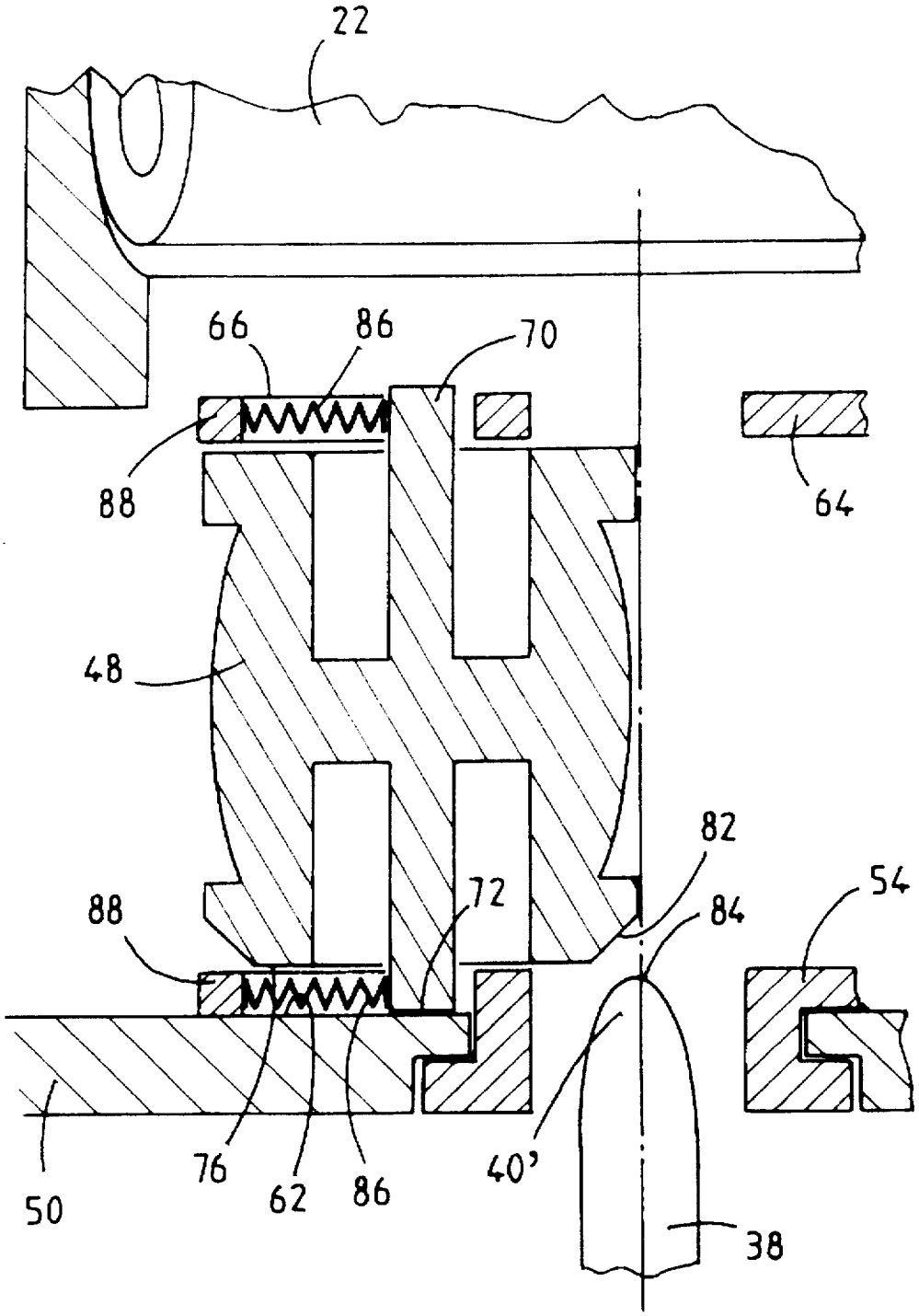
FIG. 5 shows a portion of the peristaltic pump system constituting a first variant embodiment.

FIG. 5 shows a variant embodiment which facilitates engagement of the insert 10 around the wheels 48 and then passage of the end of the shaft 38 between the wheels.

FIG. 5 shows that the periphery of the bottom face 76 of each wheel 48 is chamfered at 82. In addition, the free end of the shaft 38 now referenced 40' is curved in section in an axial plane, with curvature that diminishes going from the side wall 38*a* of the shaft to the top end 84 thereof.

In addition, return springs 86 or other resilient systems are mounted in the radial grooves 62 and 66 which receive the ends 70 and 72 of the pivot axes of the wheels, and they urge the wheels towards the axis XX' of the plate 50.

These springs are interposed between the corresponding ends 70 or 72 of the wheel pivot axes and the closed ends 88 of the slots 62 or 66.

It will be understood that the dispositions described with reference to FIG. 5 facilitate installing the insert 10 around the wheels 48 since the wheels are held close to the axis XX' by the springs 86.

When the plate 50 is being pushed down, the special shape of the end 40' of the shaft and the chamfer provided at the peripheries of the bottom faces of the wheels make it easier to pass the shaft between the wheels while pushing them back and compressing the springs 86. When the peristaltic pump is in operation, these springs increase the contact force between the lateral walls 80 of the wheels and the lateral wall of the shaft.

Figure 7:
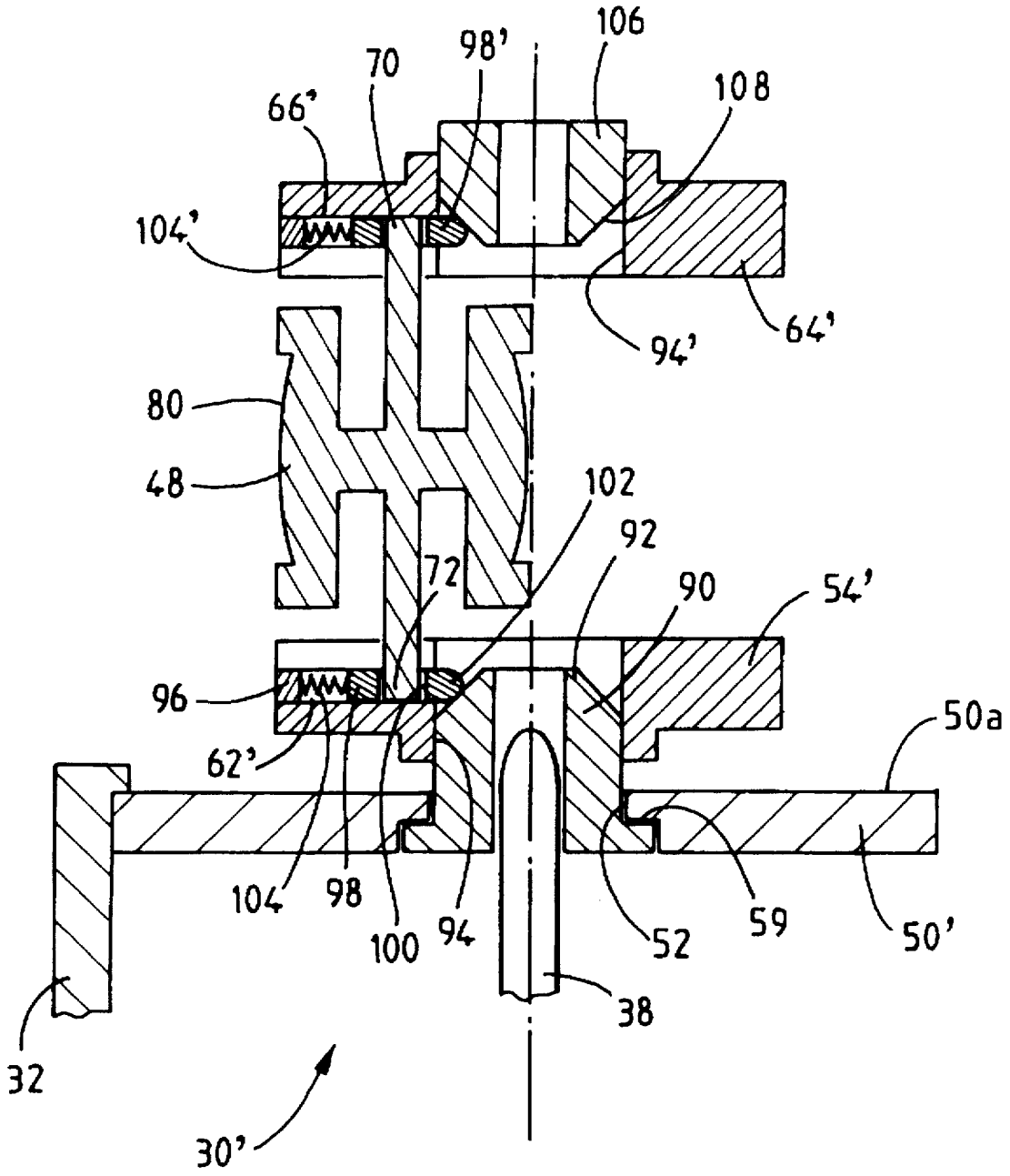
FIG. 7 is a fragmentary view of the motor portion in a second variant embodiment.

A second variant embodiment of the peristaltic pump system is described with reference to FIG. 7. Since the insert 10 is not modified, the description relates solely to the modifications made to the motor means 30'. The plate 50' is still provided with its axial orifice 52 and its shoulder 59. A sleeve 90 is mounted to rotate freely in the orifice 52. It is prevented from moving in translation along the axis XX', and its chamfered end 92 projects above the top face 50*a* of the plate. The turntable 54' corresponding to the turntable 54 of FIG. 3 has an axial bore 94 which is engaged around the sleeve 90 that is free to slide in the bore 94. The turntable 54' has the same number of radial slots 62' as there are wheels 48. Each slot 62' has one end that opens out into the bore 94 and another end 96 that is closed. A slider 98 is mounted in each slot 62'. Each slider 98 is pierced by an orifice 100 for receiving the bottom end 72 of the pivot shaft of a wheel. The end 102 of the slider facing the bore 94 is rounded in the plane of a vertical section.

A return spring 104 is mounted in each slot 62' between the slider 98 and the closed end 96 of the slot. The spring 104 causes the end 102 of the slider 98 to project into the bore 94 and bear against the chamfered portion 92 of the sleeve 90.

The top disk 64' has the same structure as the turntable 54' beneath it, having slots 66', sliders 98' receiving return springs 104' and the top ends 70 of the axes of the wheels 48. A pushbutton 106 is engaged in the axial bore 94' and has a chamfered end 108 against which the sliders 98' bear.

Figure 6A:
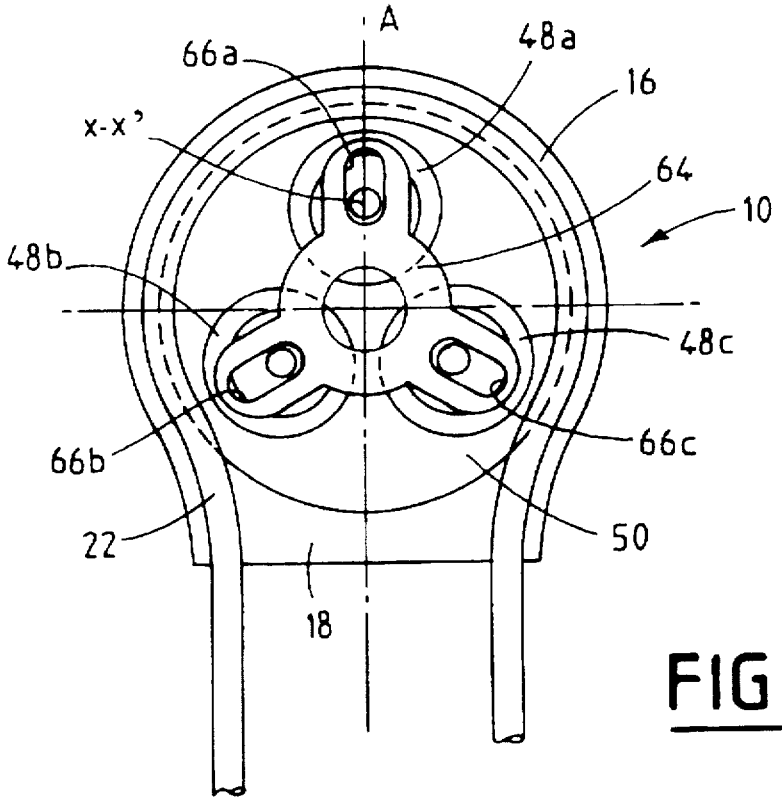
FIGS. 6*a* and 6*b* are plan views showing the insert and the wheels in the first variant embodiment respectively during engagement and while being pressed down.
Figure 6B:
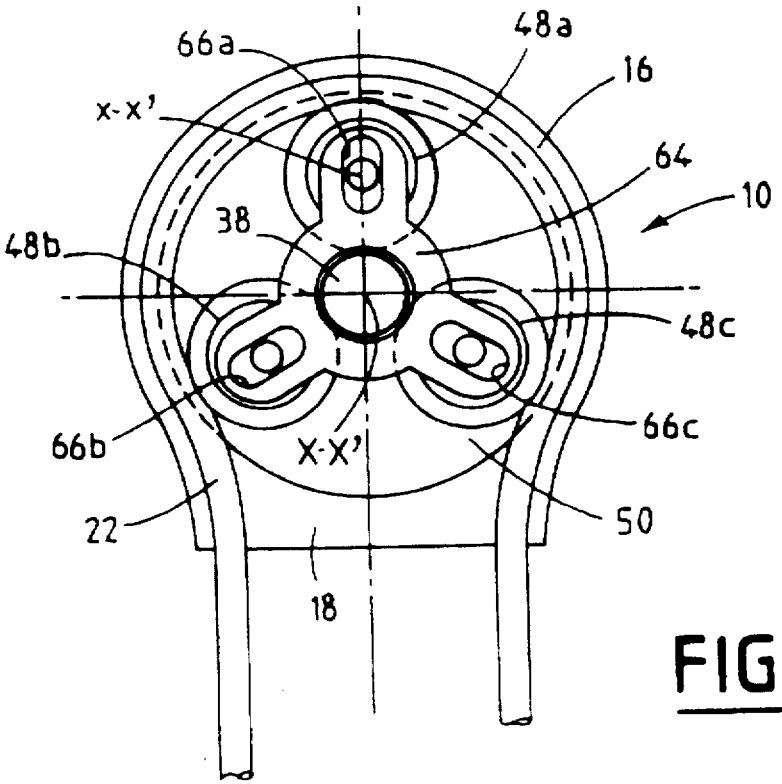

The embodiment of the peristaltic pump shown in FIGS. 6*a* and 6*b* is used as follows. At rest, the wheels 48 are pushed towards the axis XX' by the springs 104 and 104'. It is therefore very easy to engage the insert 10 around the wheels. When the insert is almost completely engaged around the wheels 48, the pushbutton 106 is pushed down into the bore 94', either by hand or via the cover of the insert if it has one. Pushing down the pushbutton 106 and the resulting engagement of the sleeve 90 in the bore 94 cause the sliders 98 and 98' to be pushed out along their slots, compressing the springs 104 and 104'. This spreads the wheels 48 apart. Spreading continues until the cylindrical portions of the sleeve 90 and of the pushbutton 106 are in contact with the sliders 98 and 98'. In this position, the distance between the tread faces 80 of the wheels is slightly less than the diameter of the shaft 38.

In the following step, the plate 50 together with the insert is pushed down into the cavity 34 of the housing. While this is taking place, the side wall of the shaft 38 pushes the wheels 48 out fully so that they compress the duct 22 locally.

The pump is then ready to be used.

As shown in FIG. 6*a*, when the motor is stopped, it is preferable for one of the wheels, the wheel 48*a* in FIG. 6*a*, to have its pivot axis xx' on the plane of symmetry AA' of the motor unit, with the other two wheels 48*b* and 48*c* being disposed symmetrically about the plane AA'. Given the curvature of the tube 22 in the insert, that means that only the wheel 48*a* is close to the tube 22 while the insert is being put into place, the wheels 48*b* and 48*c* being further away therefrom. It will be understood that this facilitates engaging the insert 10 around the wheels. This particular positioning can be obtained by combining a position sensor mounted in the housing 32 to detect the actual position of the wheels, with limited control of the motor by said sensor to bring the wheel 48*a* into the desired position.

What is claimed is:

1. A peristaltic pump system, characterized in that it comprises:

a first assembly comprising:

rotary drive means;

a shaft rotated by said drive means and having a free end;

a housing presenting a cavity into which said free end of said shaft projects;

a plurality of wheels, each wheel having a pivot axis and an active tread face that is symmetrical about said axis; and mounting means for said wheels and comprising:

a plate mounted to move in said cavity along the axis of said shaft and having an orifice suitable for allowing the free end of said shaft to pass therethrough; and movable means movable in rotation about the axis of said shaft relative to said plate, said movable means comprising means for substantially preventing said wheels from moving in translation relative to said plate along their pivot axes, for holding the pivot axes of said wheels parallel to said axis of the shaft, for allowing each wheel to rotate, and for guiding the axes of said wheels in translation along radial directions; and a second assembly, independent of the first and comprising:

a wall including at least a cylindrical portion; and a deformable tubular duct secured to the inside face of said wall;

whereby, by engaging said second assembly around the wheels of the first assembly, the tread walls of said wheels come into contact towards the axis of rotation of the mounting means in such a manner that a portion of each wheel is disposed facing said orifice; and whereby, by pushing down said mounting means into the cavity of said first assembly, the free end of said shaft penetrates through said orifice so that the side wall of the shaft co-operates with said wheels to spread said wheels apart in radial directions away from the axis of the shaft, thereby causing said tubular duct to be locally squeezed between said wheels and said wall of said second assembly.

2. A pump system according to claim 1, characterized in that said cavity of the housing of the first assembly is substantially circularly cylindrical about said shaft and includes a bottom, in that said cavity further includes means for guiding said plate in translation along the axis of said shaft, and in that said cavity is provided with resilient means interposed between said bottom and said plate tending to move said plate away from said bottom.

3. A pump system according to claim 1, characterized in that said wheel mounting means comprise a turntable mounted to rotate freely on said plate about the axis of the orifice in said plate and provided with a passage in register with said orifice and suitable for passing said shaft.

4. A pump system according to claim 3, characterized in that it comprises n wheels, each wheel further presenting two end faces perpendicular to its pivot axis, the ends of said pivot axis projecting beyond said end faces.

5. A pump system according to claim 4, characterized in that said turntable of the mounting means comprises n slideway forming means suitable for receiving respective ends of the pivot axes of said wheels, said slideway forming means extending radially relative to the axis of said passage.

6. A pump system according to claim 5, characterized in that said mounting means include a top disk secured to said turntable and parallel therewith, said top disk having n other slideway forming means to receive the respective other ends of the pivot axes of said wheels.

7. A pump system according to claim 6, characterized in that each slideway forming means is provided with a slider having an orifice, the ends of the pivot axes of the wheels being engaged in said orifices, resilient means being disposed in each slideway forming means between the outer end of a slideway forming means and the corresponding slider.

8. A pump system according to claim 7, characterized in that said first assembly further comprises pushbutton forming means movable in translation relative to said turntable and said top disk, suitable for co-operating with said sliders to cause said wheels to be spread apart in limited manner prior to the assembly means being pushed down into the cavity of said first assembly.

9. A pump system according to claim 4, characterized in that the periphery of the end face of each wheel closest to said plate is chamfered.

10. A pump system according to claim 1, characterized in that the end of said shaft is conical to facilitate passing said shaft between said wheels when said mounting means are being pushed down into the cavity.

11. A pump system according to claim 1, characterized in that the end of said shaft has an outline in an axial section plane presenting a radius of curvature that decreases going away from the cylindrical portion of said shaft.

12. A pump system according to claim 1, characterized in that said assembly means further comprise resilient means urging said wheels towards the center of said plate.

13. A pump system according to claim 1, characterized in that said tubular duct is elliptical in shape in right section.

* * * * *